US010060160B2

(12) United States Patent
Wang et al.

(10) Patent No.: US 10,060,160 B2
(45) Date of Patent: Aug. 28, 2018

(54) LATCH ASSEMBLY

(71) Applicant: TAIWAN FU HSING INDUSTRIAL CO., LTD., Kaohsiung (TW)

(72) Inventors: Ching-Kai Wang, Changhua County (TW); Chih-Lung Lin, Changhua County (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 319 days.

(21) Appl. No.: 14/632,056

(22) Filed: Feb. 26, 2015

(65) Prior Publication Data

US 2016/0145906 A1 May 26, 2016

(30) Foreign Application Priority Data

Nov. 24, 2014 (TW) ..... 103220776 U

(51) Int. Cl.
*E05B 65/10* (2006.01)
*E05B 17/20* (2006.01)
(Continued)

(52) U.S. Cl.
CPC ..... *E05B 65/104* (2013.01); *E05B 15/006* (2013.01); *E05B 15/0093* (2013.01);
(Continued)

(58) Field of Classification Search
CPC ..... E05C 1/02; E05C 1/002; E05C 19/007; E05C 19/009; E05B 15/0053; E05B 15/006; E05B 15/008; E05B 17/2011; E05B 17/2015; E05B 65/10; E05B 65/104; E05B 15/0093; E05B 65/5292; Y10S 292/65; Y10S 292/66; Y10T 292/0969; Y10T 292/097; Y10T 292/096; Y10T 292/1014;
(Continued)

(56) References Cited

U.S. PATENT DOCUMENTS 18,157 A * 9/1857 Perry ..... E05B 65/0082 105/37
504,262 A * 8/1893 Adams ..... E05B 65/0864 292/150
(Continued)

FOREIGN PATENT DOCUMENTS

EP 0471112 A1 * 2/1992 ..... E05B 65/104
EP 2011938 A1 * 1/2009 ..... E05B 47/0038
KR 20100110424 A * 10/2010 ..... E05B 65/104

*Primary Examiner* — Christine M Mills
(74) *Attorney, Agent, or Firm* — Jackson IPG PLLC; Demian K. Jackson

(57) ABSTRACT

A latch assembly disposed in an anti-fire door includes a tube, a blocking pin, an elastic member and a wedging member, wherein the tube comprises a main body and an accommodating space. The main body comprises a constraining slot communicating with the accommodating space, wherein the blocking pin, the elastic member and the wedging member are disposed in the accommodating space. The elastic member is used for pushing the blocking pin and the wedging member to move and making the blocking pin protruding to the tube and lodging in a door frame. The wedging member lodged in the constraining slot is used for blocking the blocking pin protruded to the tube therefore preventing the blocking pin from retracting back into the accommodating space.

7 Claims, 9 Drawing Sheets

(51) Int. Cl.
*E05B 15/00* (2006.01)
*E05C 1/02* (2006.01)

(52) U.S. Cl.
CPC ..... *E05B 17/2011* (2013.01); *E05B 17/2015* (2013.01); *E05C 1/02* (2013.01); *Y10S 292/66* (2013.01); *Y10T 292/0969* (2015.04)

(58) Field of Classification Search
CPC ..... Y10T 292/0908; Y10T 292/0909; Y10T 292/091; Y10T 292/1028; Y10T 292/1006; Y10T 292/1007; Y10T 292/1013
USPC ..... 292/163, 164, 137, 138, 92, 93, 94, 292/DIG. 65, DIG. 66, 150, 183, 184, 189
See application file for complete search history.

(56) References Cited

U.S. PATENT DOCUMENTS 543,226 A * 7/1895 Atwood ..... E05B 65/0864 292/150
656,062 A * 8/1900 Kannel ..... 292/DIG. 65
1,364,749 A * 1/1921 Graybeal ..... E05B 17/2019 292/150
1,541,093 A * 6/1925 Amico ..... E05B 17/2057 292/150
3,705,739 A * 12/1972 Adler ..... E05B 65/104 16/48.5
3,811,717 A * 5/1974 Floyd ..... E05B 65/104 16/48.5
4,003,593 A * 1/1977 Wilzig ..... E05B 65/104 292/165
4,007,954 A * 2/1977 Erickson ..... A62C 2/242 292/165
4,183,565 A * 1/1980 Allemann ..... E05B 65/104 292/150
4,343,500 A * 8/1982 Steiner ..... E05C 17/48 16/82
4,726,613 A * 2/1988 Foshee ..... E05B 65/104 292/150
5,121,950 A * 6/1992 Davidian ..... E05B 65/104 292/164
8,979,143 B1 * 3/2015 Lin ..... E05B 17/2034 292/153
2014/0203569 A1 * 7/2014 Stile ..... E05B 15/024 292/137

* cited by examiner

LATCH ASSEMBLY

FIELD OF THE INVENTION

The present invention is generally relating to a latch assembly. The invention particularly represents the latch assembly that prevents a blocking pin from retracting back into a tube.

BACKGROUND OF THE INVENTION

With reference to FIG. 9, a conventional latch assembly 400 used for disposing in an anti-fire door 500 comprises a tube body 410, a blocking member 420, a blocking pin 430, an elastic member 440 and a cover 450. The blocking member 420 and the cover 450 constrain the blocking pin 430 and the elastic member 440 in the tube body 410. High temperature results in melting of the blocking member 420 and makes the elastic member 440 pushing the blocking pin 430 to protrude to the tube body 410 when a fire accident occurs. The blocking pin 430 is wedged in the tube body 410 and a door frame 600 at the same time to make the anti-fire door 500 unable to be opened.

Owing to the blocking pin 430 disposed in the anti-fire door 500, the anti-fire door 500 and the blocking pin 430 produce deformation followed by environmental temperature variance of the fire scene. A space between the blocking pin 430 and the cover 450 used for accommodating the elastic member 440 instead becomes the space that allows the blocking pin 430 to retract back into the tube body 410.

The blocking pin 430 departs from the door frame 600 to make the latch assembly 400 unable to constrain the anti-fire door 500 to be unable to be opened when the blocking pin 430 deforms to make the blocking pin 430 retract back into the tube body 410.

SUMMARY

The primary object of the present invention is to provide a latch assembly coupled to an anti-fire door, and wherein the latch assembly is lodged in a constraining slot via a wedging member so as to keep a blocking pin from retracting back into a tube for preventing the anti-fire door from being opened.

A latch assembly of the present invention coupled to an anti-fire door includes a tube, a blocking pin, an elastic member and a wedging member. The tube comprises a main body and an accommodating space surrounded by the main body, wherein the accommodating space comprises an opening, and a lateral axis passes through the accommodating space. The main body comprises a constraining slot communicating with the accommodating space, wherein the blocking pin and the elastic member are disposed in the accommodating space. The elastic member is compressed by the blocking pin to produce an elastic restoration force. The wedging member is disposed at the blocking pin and located at a first position. The elastic member pushes the blocking pin to move along the lateral axis by the elastic restoration force, and the wedging member is displaced simultaneously with the blocking pin. The wedging member moves from the first position to a second position and is lodged in the constraining slot for keeping the blocking pin from moving reversely when a first terminal of the blocking pin protrudes to the opening.

DETAILED DESCRIPTION OF THE INVENTION

Figure 1:
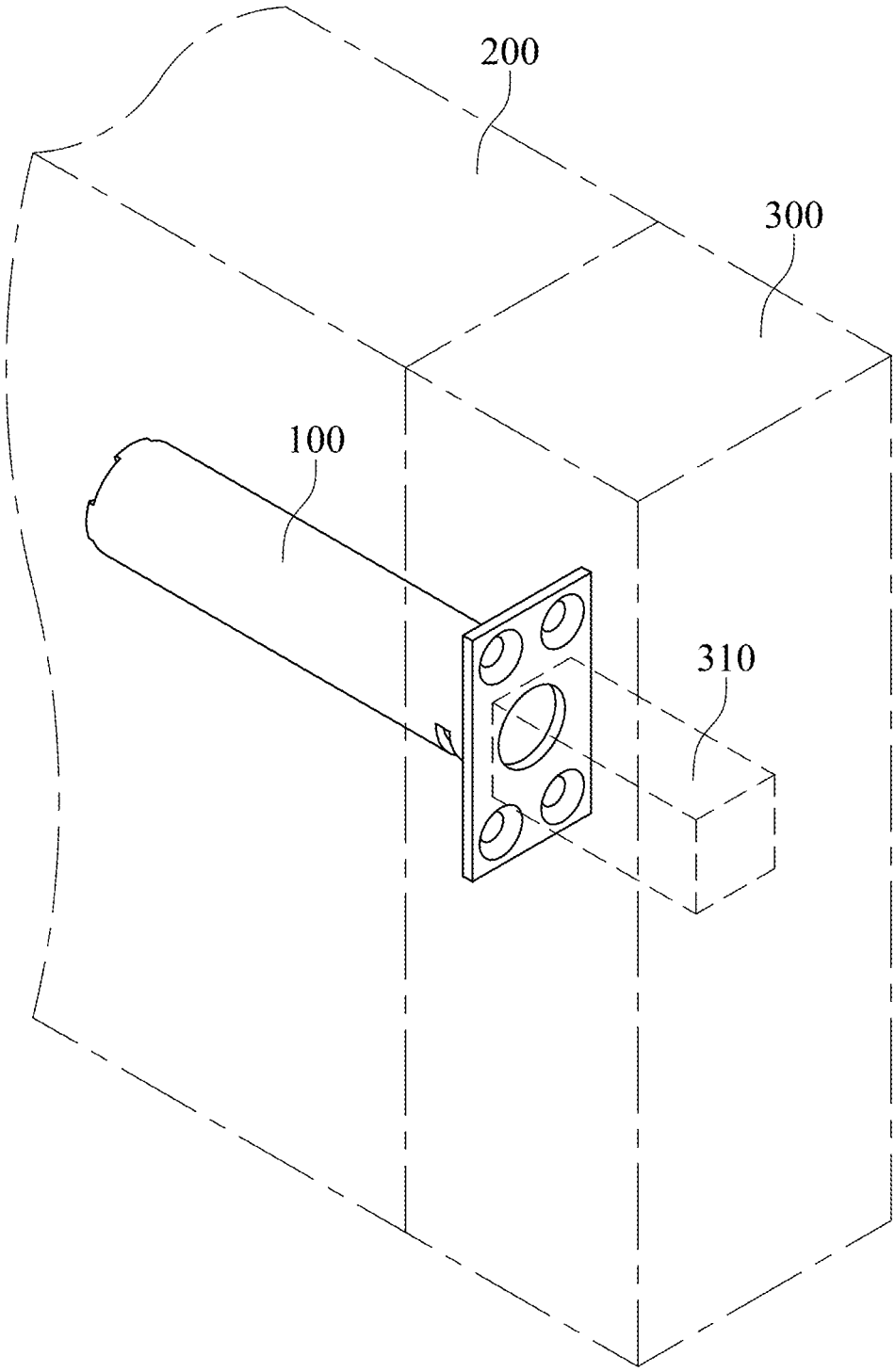
FIG. 1 is a perspective diagram illustrating a latch assembly disposed in an anti-fire door in accordance with the first embodiment of the present invention.

With reference to FIG. 1, a latch assembly 100 of the present invention is disposed in an anti-fire door 200 engaged with a door frame 300. The anti-fire door 200 is able to be opened or closed relative to the door frame 300. The door frame 300 comprises a constraining hole 310, wherein the constraining hole 310 corresponds to the latch assembly 100 when the anti-fire door 200 is closed.

Figure 2:
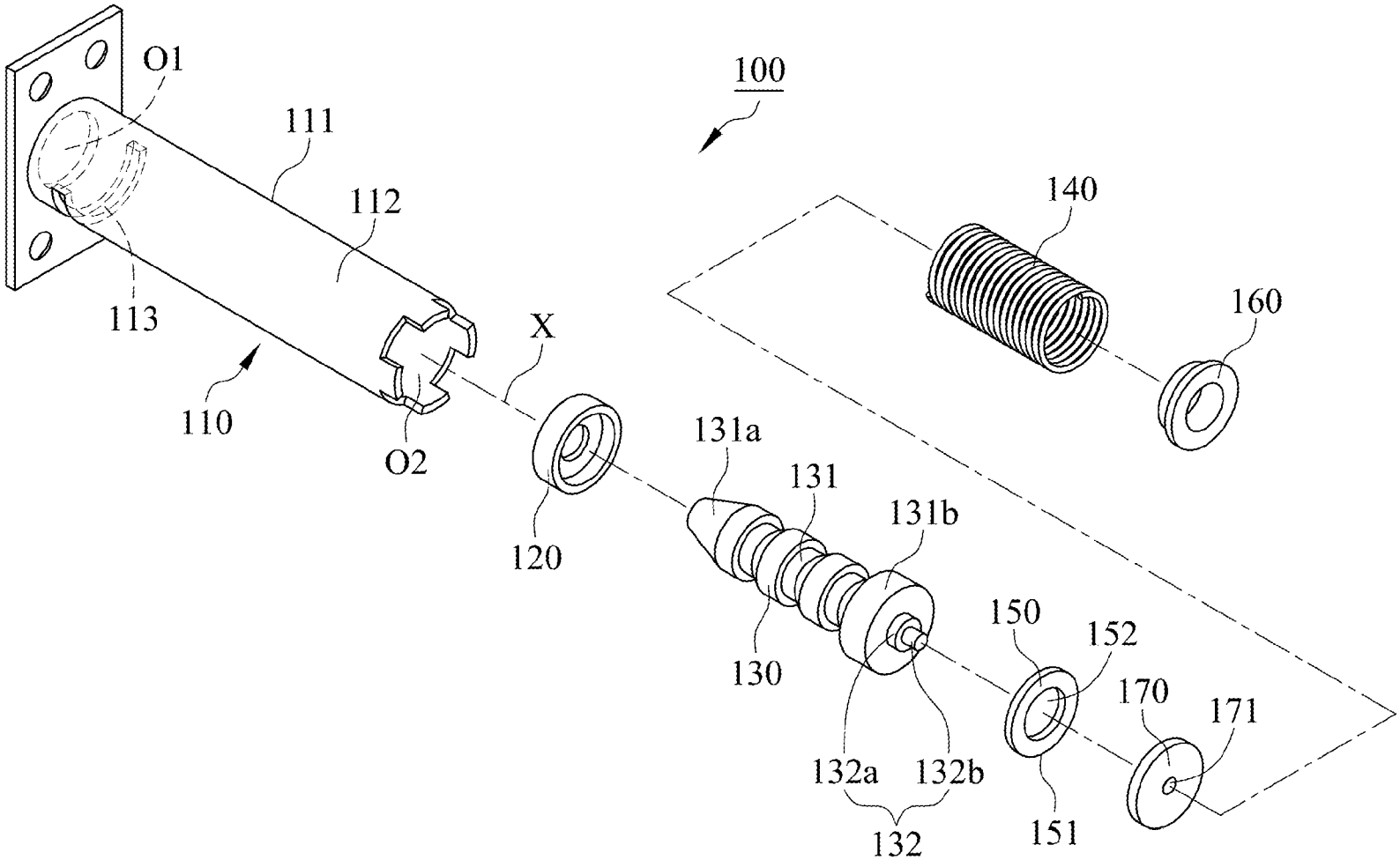
FIG. 2 is a perspective exploded diagram illustrating the latch assembly in accordance with the first embodiment of the present invention.

With reference to FIG. 2, the latch assembly 100 in accordance with a first embodiment of the present invention includes a tube 110, a blocking member 120, a blocking pin 130, an elastic member 140 and a wedging member 150. The tube 110 comprises a main body 111 and an accommodating space 112 surrounded by the main body 111. An lateral axis X passes through the accommodating space 112, wherein the blocking member 120, the blocking pin 130, the elastic member 140 and the wedging member 150 are disposed in the accommodating space 112, and the blocking pin 130 and the wedging member 150 are able to move along the lateral axis X.

Figure 3:
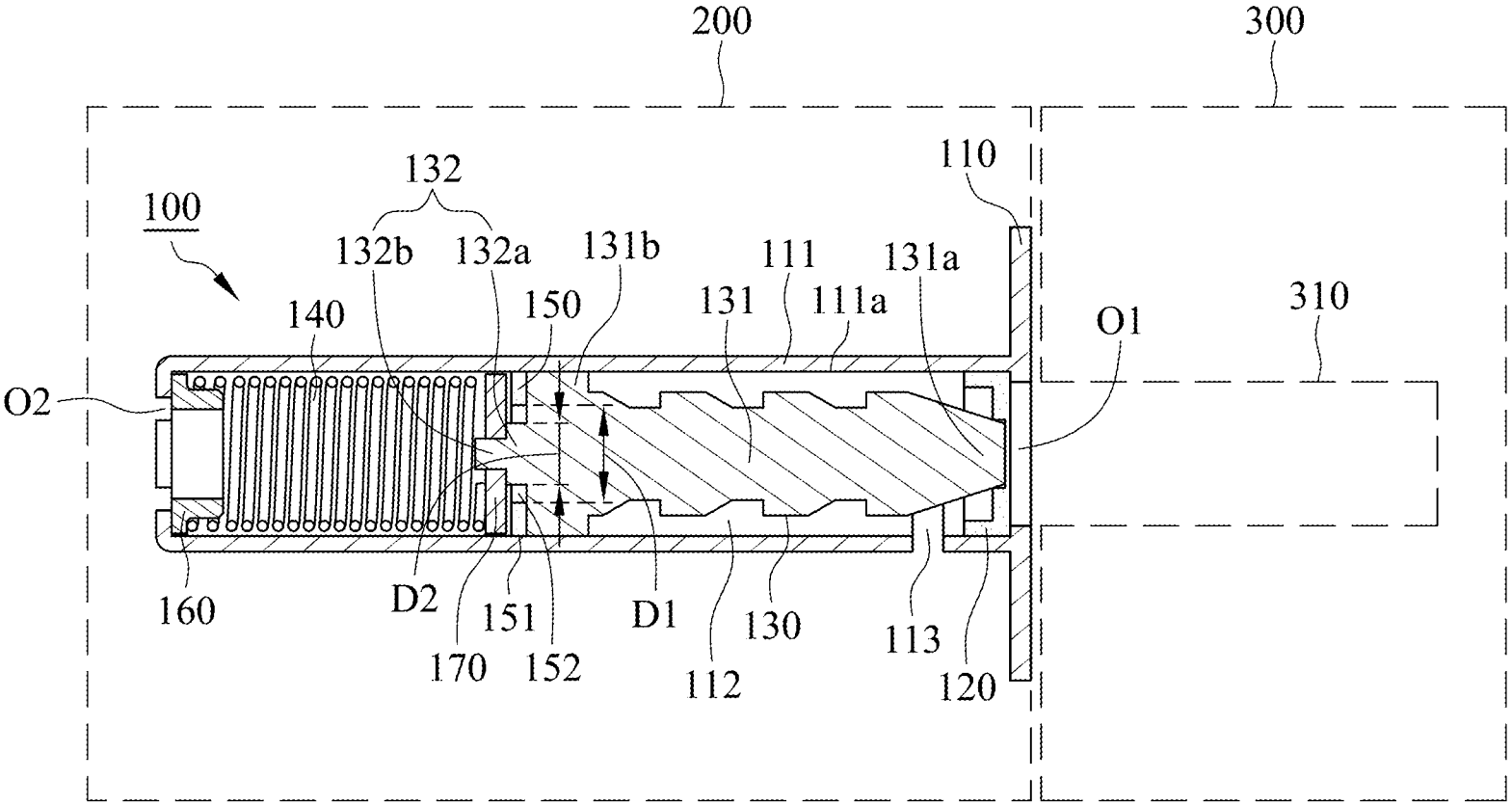
FIG. 3 is a section view illustrating the latch assembly prior to operation in accordance with the first embodiment of the present invention.

With reference to FIGS. 2 and 3, in this embodiment, the accommodating space 112 comprises an opening O1, the main body 111 comprises a constraining slot 113 communicating with the accommodating space 112, and wherein the blocking member 120 is disposed at the opening O1. The blocking pin 130 comprises a rod body 131, wherein a first terminal 131*a* of the rod body 131 contacts against the blocking member 120 that is disposed at the opening O1. The blocking pin 130 is located between the blocking member 120 and the elastic member 140. The elastic member 140 is used for pushing the blocking pin 130 to move toward the opening O1 along the lateral axis X.

With reference to FIGS. 2 and 3, in this embodiment, the latch assembly 100 further includes a fixing member 160, the accommodating space 112 further comprises an installing opening O2, wherein the blocking member 120, the blocking pin 130 and the elastic member 140 are disposed in the accommodating space 112 via the installing opening O2 in sequence. The fixing member 160 is disposed at the installing opening O2 for making the blocking pin 130 and the elastic member 140 constrained in the accommodating space 112.

With reference to FIG. 3, the elastic member 140 is disposed between the blocking pin 130 and the fixing member 160, and the elastic member 140 is compressed by the blocking pin 130 to produce an elastic restoration force. In this embodiment, the wedging member 150 is disposed at the blocking pin 130 and moves with the blocking pin 130. FIG. 3 illustrates the condition that before the elastic member 140 pushes the blocking pin 130 to move toward the opening O1, the wedging member 150 is located at a first position.

With reference to FIGS. 2 and 3, in this embodiment, the blocking pin 130 further comprises a supporting member 132 protruded to a second terminal 131*b* of the blocking pin 130. The wedging member 150 is disposed at the supporting member 132 of the blocking pin 130 and comprises a bottom edge 151 and a first through hole 152, wherein the supporting member 132 penetrates through the first through hole 152 of the wedging member 150, and a first hole diameter D1 of the first through hole 152 is larger than an outer diameter D2 of the supporting member 132. The bottom edge 151 contacts against an inner lateral wall 111*a* of the main body 111 when the wedging member 150 is located at the first position.

Figure 4:
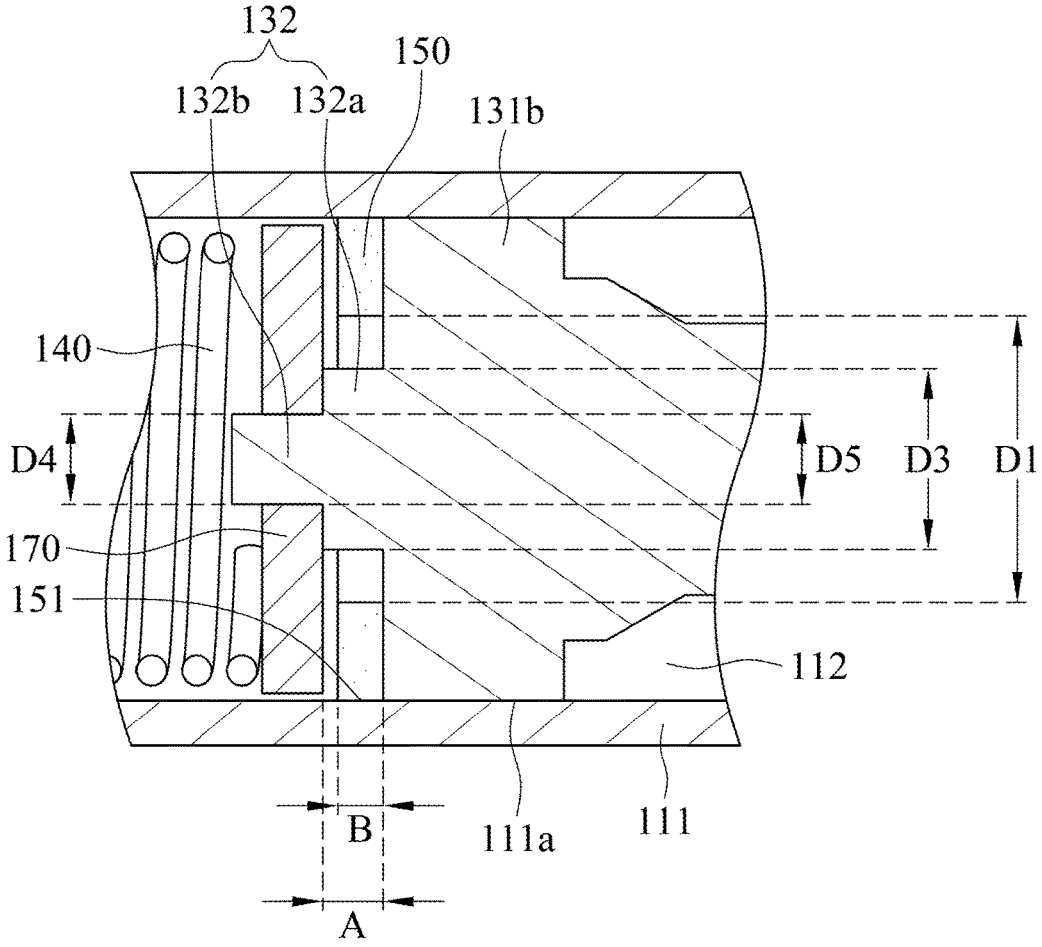
FIG. 4 is a partial enlargement view of FIG. 3.

With reference to FIGS. 2, 3 and 4, in this embodiment, the latch assembly 100 further includes a bearing member 170 disposed at the supporting member 132, and the wedging member 150 is located between the second terminal 131*b* of the blocking pin 130 and the bearing member 170. A spacing A is spaced apart between the bearing member 170 and the second terminal 131*b* of the blocking pin 130, wherein the spacing A is larger than a thickness B of the wedging member 150.

With reference to FIGS. 2, 3 and 4, in this embodiment, the supporting member 132 comprises a first supporting portion 132*a* and a second supporting portion 132*b* connected to the first supporting portion 132*a*, wherein the first supporting portion 132*a* is disposed between the second terminal 131*b* of the blocking pin 130 and the second supporting portion 132*b*. A first outer diameter D3 of the first supporting portion 132*a* is larger than a second outer diameter D4 of the second supporting portion 132*b*. In this embodiment, the first supporting portion 132*a* penetrates through the first through hole 152 of the wedging member 150, and the first hole diameter D1 of the first through hole 152 is larger than the first outer diameter D3 of the first supporting portion 132*a*.

With reference to FIGS. 2, 3 and 4, in this embodiment, the bearing member 170 comprises a second through hole 171, and the second supporting portion 132*b* penetrates through the second through hole 171 of the bearing member 170, and wherein a second hole diameter D5 of the second through hole 171 is smaller than the first outer diameter D3 of the first supporting portion 132*a*. The bearing member 170 is constrained at the second supporting portion 132*b*. In this embodiment, the elastic member 140 contacts against the bearing member 170, and the elastic member 140 pushes the supporting member 132 of the blocking pin 130 by the bearing member 170.

Figure 5:
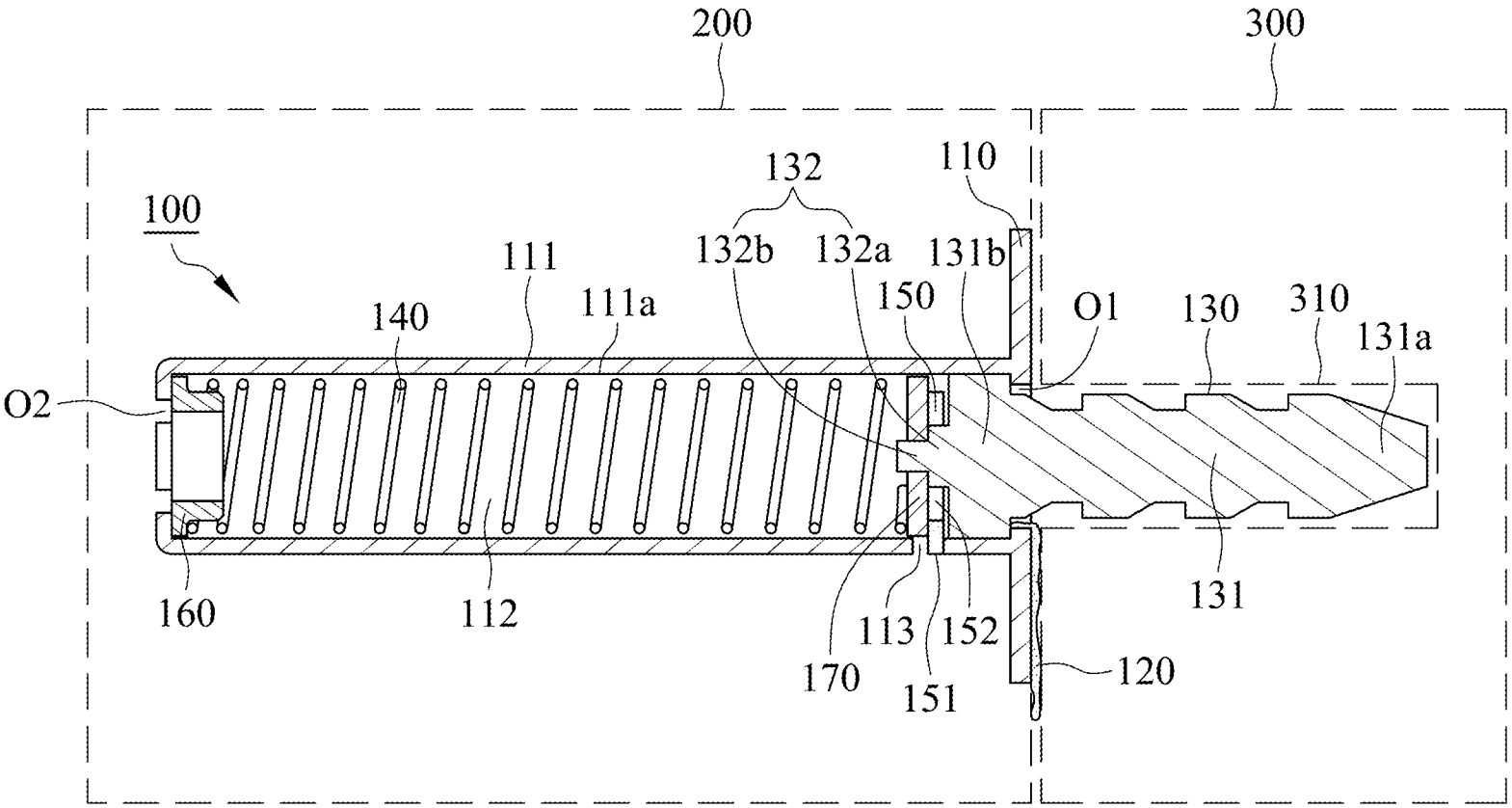
FIG. 5 is a section view illustrating the latch assembly after operation in accordance with the first embodiment of the present invention.

With reference to FIG. 5, the blocking member 120 is a low melt point material, the melting point of the fixing member 160 is higher than the melting point of the blocking member 120, preferably, and the blocking member 120 is selected from a plastic material. The blocking member 120 will be melted and unable to constrain the blocking pin 130 inside the accommodating space 112 when a fire occurs. Therefore, the elastic member 140 is able to push the blocking pin 130 to move toward the opening O1 along the lateral axis X by the elastic restoration force and the wedging member 150 is displaced simultaneously with the blocking pin 130.

With reference to FIG. 5, the wedging member 150 moves to a second position with the blocking pin 130, and aims at the constraining slot 113 and is lodged in the constraining slot 113 when the first terminal 131*a* of the blocking pin 130 protrudes to the opening O1 of the accommodating space 112 and the blocking pin 130 is lodged in the constraining hole 310 of the door frame 300. The wedging member 150 is used to block the blocking pin 130 so as to keep the blocking pin 130 from retraction from the constraining hole 310 of the door frame 300 to the accommodating space 112 therefore preventing the anti-fire door 200 from being opened.

Figure 6:
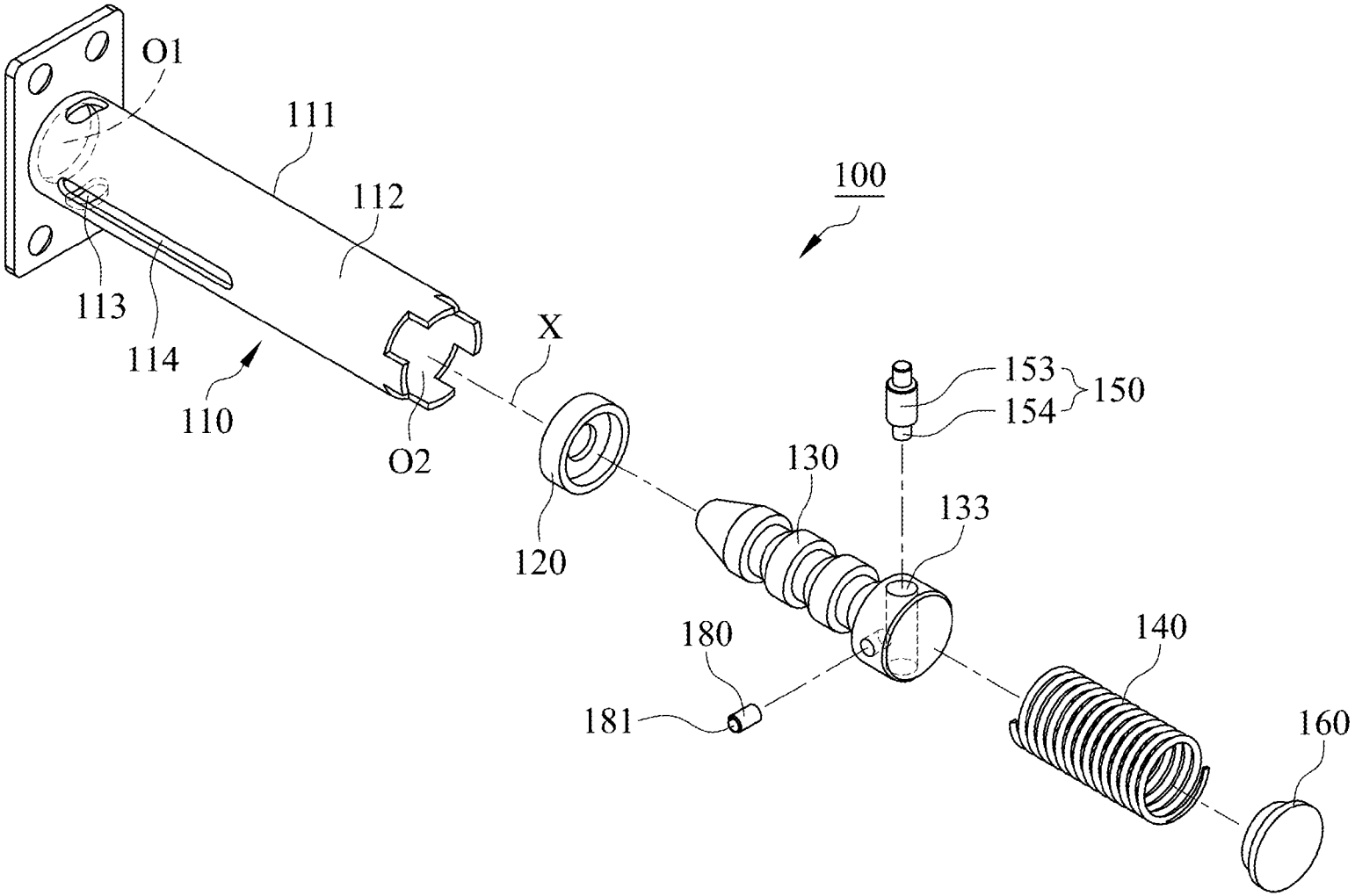
FIG. 6 is a perspective exploded diagram illustrating the latch assembly in accordance with the second embodiment of the present invention.
Figure 7:
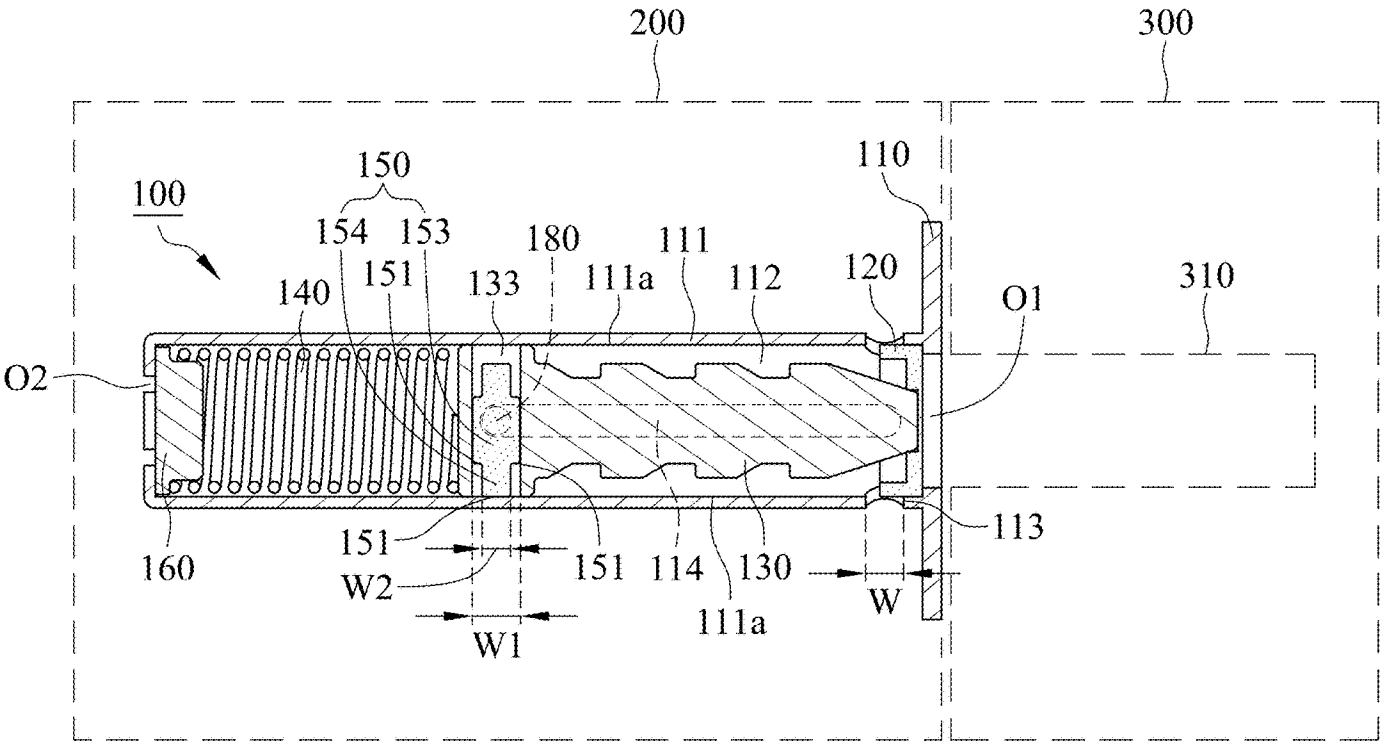
FIG. 7 is a section view illustrating the latch assembly prior to operation in accordance with the second embodiment of the present invention.

With reference to FIGS. 6 and 7, a second embodiment of the present invention is illustrated in mentioned Figs. The primary difference between the second embodiment and the first embodiment is the second embodiment canceling the supporting member 132 and the bearing member 170 of the first embodiment, and an accommodating hole 133 is disposed at the blocking pin 130, and the latch assembly 100 further comprises a guiding member 180, and the main body 111 of the tube 110 further comprises a guiding rail 114. In the second embodiment, the wedging member 150 is a pillar-shaped body and movably disposed in the accommodating hole 133. The guiding member 180 is engaged with the blocking pin 130, and the wedging member 150 and the guiding member 180 move simultaneously with the blocking pin 130. The guiding member 180 comprises a constraining terminal 181, wherein the constraining terminal 181 is constrained in the guiding rail 114.

With reference to FIGS. 6 and 7, in the second embodiment, the wedging member 150 comprises a positioning portion 153 and a lodging portion 154 connected to the positioning portion 153, wherein a first width W1 of the positioning portion 153 is larger than a limiting width W of the constraining slot 113, and a second width W2 of the lodging portion 154 is smaller than the limiting width W of the constraining slot 113.

Figure 8:
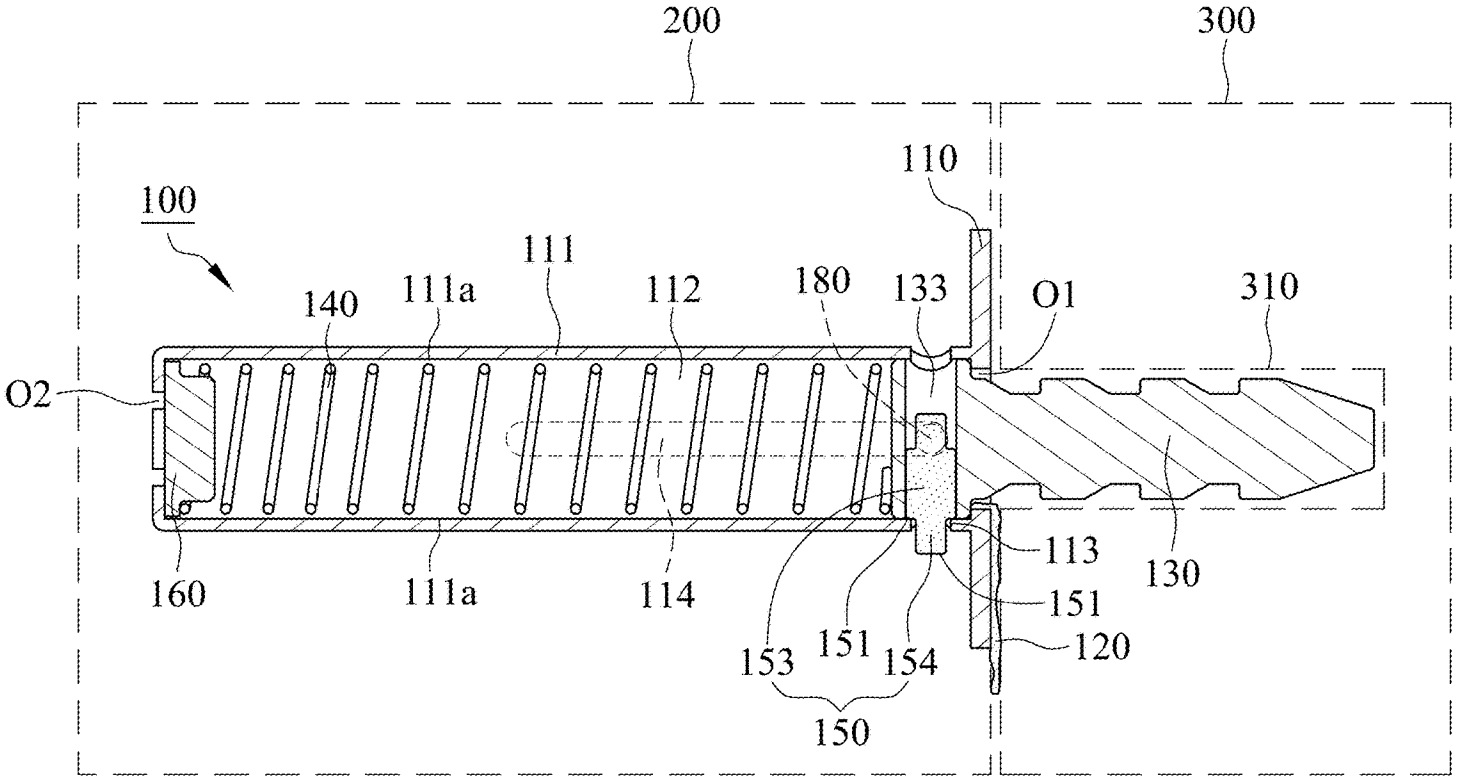
FIG. 8 is a section view illustrating the latch assembly after operation in accordance with the second embodiment of the present invention.
Figure 9:
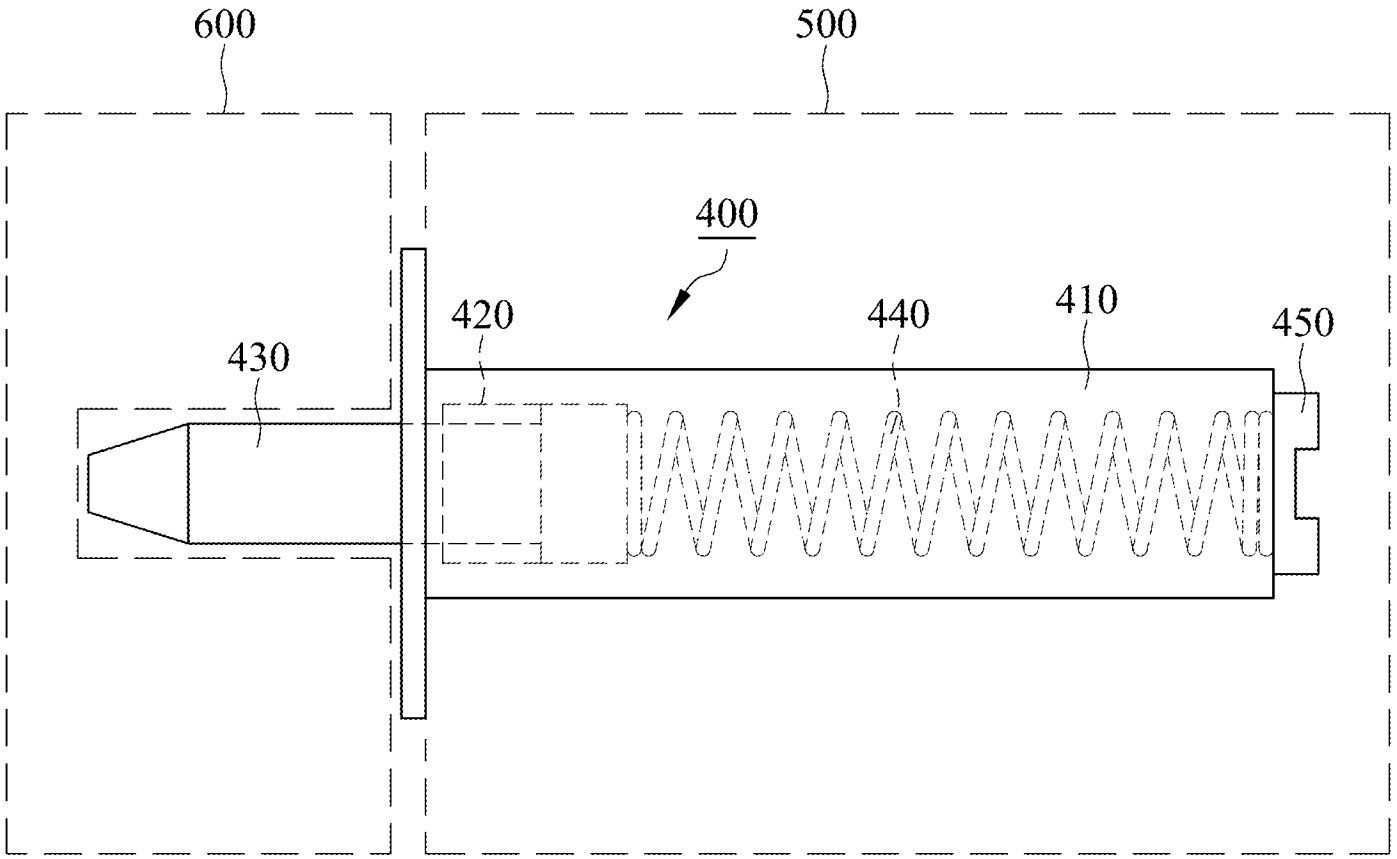
FIG. 9 PRIOR ART
FIG. 9 is a lateral section view of a conventional latch assembly in a locked state.

With reference to FIG. 7, the lodging portion 154 contacts against the inner lateral wall 111*a* of the main body 111 when the wedging member 150 is located at the first position. Referring to FIG. 8, the elastic member 140 pushes the blocking pin 130 to move toward the opening O1, and the wedging member 150 and the guiding member 180 are displaced simultaneously with the blocking pin 130 when a fire occurs.

With reference to FIG. 8, owing to the constraining terminal 181 of the guiding member 180 is constrained in the guiding rail 114, so the condition that the wedging member 150 is not able to aim at the constraining slot 113 because of the rotation of the blocking pin 130 moving in the accommodating space 112 is avoidable when the wedging member 150 moves from the first position to the second position.

With reference to FIG. 8, the wedging member 150 aims at the constraining slot 113, and the lodging portion 154 of the wedging member 150 is lodged in the constraining slot 113 when the wedging member 150 moves to the second position. The positioning portion 153 is constrained in the accommodating hole 133 of the blocking pin 130 to make the lodging portion 154 of the wedging member 150 block the blocking pin 130 for preventing the blocking pin 130 from retraction from the constraining hole 310 of the door frame 300 to the accommodating space 112 therefore avoiding the anti-fire door 200 from being opened.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A latch assembly comprising:

a tube having a main body and an accommodating space surrounded by the main body, wherein the accommodating space comprises an opening, a lateral axis passes through the accommodating space, the main body comprises a constraining slot communicating with the accommodating space;

a blocking pin having an accommodating hole and wherein the blocking pin is disposed in the accommodating space;

a blocking member disposed at the opening and having a melted condition and an un-melted condition, wherein when the blocking member is un-melted, the blocking member contacts against the blocking pin and constrains the blocking pin inside the accommodating space to prevent the blocking pin from protruding through the opening;

an elastic member disposed in the accommodating space and compressed by the blocking pin to produce an elastic restoration force when the blocking member is un-melted; and a wedging member movably disposed in the accommodating hole of the blocking pin and located at a first position when the blocking member is un-melted and, wherein, when the blocking member is melted, the elastic member pushes the blocking pin to move along the lateral axis by the elastic restoration force to urge a first terminal of the blocking pin to protrude through the opening and such that the wedging member moves simultaneously with the blocking pin from the first position to a second position and then moves downwardly by gravity alone to lodge into the constraining slot for keeping the blocking pin from moving reversely and wherein the wedging member comprises a bottom edge continuously contacting against an inner lateral wall of the main body as the wedging member is moved from the first position to the second position.

2. The latch assembly in accordance with claim 1, wherein the wedging member comprises a positioning portion and a lodging portion connected to the positioning portion, the lodging portion of the wedging member is lodged in the constraining slot and the positioning portion is constrained in the accommodating hole of the blocking pin when the wedging member moves to the second position.

3. The latch assembly in accordance with claim 1 further includes a guiding member engaged with the blocking pin and moving simultaneously with the blocking pin, the guiding member comprises a constraining terminal, the main body comprises a guiding rail, and wherein the constraining terminal of the guiding member is constrained in the guiding rail.

4. The latch assembly in accordance with claim 1, wherein the blocking member is made of material having a low melting point.

5. The latch assembly in accordance with claim 4 further includes a fixing member, and the accommodating space further comprises an installing opening, wherein the fixing member is disposed at the installing opening for making the blocking pin and the elastic member constrained in the accommodating space.

6. The latch assembly in accordance with claim 5, wherein the fixing member has a melting point which is higher than the melting point of the blocking member.

7. The latch assembly in accordance with claim 1 further includes a fixing member, and the accommodating space further comprises an installing opening, wherein the fixing member is disposed at the installing opening for making the blocking pin and the elastic member constrained in the accommodating space.

* * * * *